United States Patent [19]

Aubry et al.

[11] 4,260,993

[45] Apr. 7, 1981

[54] DUAL-BAND ANTENNA WITH PERISCOPIC SUPPLY SYSTEM

[75] Inventors: Claude Aubry; Daniel Renaud, both of Paris, France

[73] Assignee: Thomson-CSF, Paris, France

[21] Appl. No.: 49,505

[22] Filed: Jun. 18, 1979

[30] Foreign Application Priority Data

Jun. 20, 1978 [FR] France ..... 78 18408

[51] Int. Cl.[3] ..... H01Q 3/12; H01Q 19/19

[52] U.S. Cl. ..... 343/779; 343/781 CA; 343/839

[58] Field of Search ..... 343/781 R, 781 P, 781 CA, 343/839, 840, 779

[56] References Cited

U.S. PATENT DOCUMENTS

| | | | |
|---|---|---|---|
| 3,698,001 | 10/1972 | Koyama et al. | 343/781 CA |
| 3,845,483 | 10/1974 | Soma et al. | 343/781 CA |

*Primary Examiner*—Eli Lieberman

*Attorney, Agent, or Firm*—Karl F. Ross

[57] ABSTRACT

A dual-band antenna for the transmission and reception of radiant energy has a Cassegrain-type reflector assembly, rotatable about an azimuth axis and pivotable about an elevational axis, to which two outgoing beams are directed in a transmitting mode by a periscopic supply system including a set of four mirrors, two of them flat and two of them concave. The lower-band beam originates at a first feed comprising a horizontally radiating horn and two confronting concave mirrors, one of these mirrors training the beam onto a slanting dichroic mirror reflecting same upward into the periscopic supply system. The higher-band beam originates at a second feed also comprising a horizontal horn which radiates onto a concave mirror reflecting the beam upward through the dichroic mirror into the periscopic supply system along a path coinciding with that of the other beam.

3 Claims, 3 Drawing Figures

DUAL-BAND ANTENNA WITH PERISCOPIC SUPPLY SYSTEM

FIELD OF THE INVENTION

The present invention relates to a dual-band antenna with a periscopic supply of radiant energy. Our invention is more particularly applicable to an antenna operating with frequency reuse by orthogonal polarizations.

BACKGROUND OF THE INVENTION

Antennas of the frequency-reusing kind are known to operate simultaneously and independently with two orthogonal polarizations. They comprise a system of reflectors, of the Cassegrain type for example, a primary source of radiation, and a periscope ensuring the transmission of the radiated beam from the source to the reflectors; the periscope is formed by an assembly of four mirrors whose curvatives determine the operating frequency.

The system of reflectors is movable along two mutually perpendicular axes, namely elevational and azimuth axes respectively designated EL and AZ in FIG. 1 which shows a conventional single-band antenna.

In FIG. 1, the supply device comprises a fixed primary source 1 of the corrugated-horn type centered on the AZ axis. The periscope comprises a cylindrical structure 2, movable around this axis AZ, and four mirrors 3, 4, 5 and 6, the mirrors 3 and 6 (or possibly 4 and 6) being flat while the other two mirrors have a focusing (paraboloidal or ellipsoidal) curvature. An outgoing microwave beam is reflected successively by these mirrors 3, 4, 5 and 6.

The disposition of these mirrors in the periscope is well known for frequency-reusing antennas. Thus, the first mirror 3 is centered on the azimuth axis AZ; mirrors 3, 4 and 5 are integral with the structure 2 and therefore movable around the azimuth axis, whereas the fourth mirror 6 is integral with a rotatable and pivotable assembly including a main reflector 7 and a secondary reflector 8, being therefore movable around the azimuth axis as well as around the axis of elevation EL. This fourth mirror 6 is centered on the intersection of the azimuth and elevation axes.

In the field of spatial telecommunications it is desirable to utilize the same frequency-reusing antenna for two frequency bands, i.e. to associate a second band of higher frequencies with the single band of lower operating frequencies employed with the antenna described above. In a specific instance, the lower band ranges from 4 to 6 GHz and the higher band extends from 11 to 14 GHz. Therefore, a certain minimum alteration of the single-band antenna described above is needed to permit dual-frequency operation.

To this end it is necessary in all cases to attach a second supply device to the antenna to emit the waves of the higher band. It is impossible to place two horns on the azimuth axis of the antenna, as is done with the horn 1 in FIG. 1, as one inevitably would shield the other. An alternative positioning of the two supply devices and the periscope must therefore be adopted.

According to a prior-art solution shown diagrammatically in FIG. 2, a periscope 60 differs from structure 2 of FIG. 1 in that the first, flat mirror 3 is replaced by a dichroic mirror 30. This dichroic mirror is a device which is transparent for one band and reflective for another and which thus permits the combination of two separately transmitted beams into one. Inversely, it also permits the separation of received beams of different frequencies. There are at least three well known structures for this type of mirror:

a rectangular-mesh parallel-grid structure of metal wires or strips impressed on a very thin support of the mylar type, a structure of parallel metal grids pierced with cross-shaped slots, a network of waveguides cutting off one frequency band and passing the other.

A particular mirror structure of the first of the three types mentioned above is described in an article entitled "Quasi-Optical Polarization-Independent Diplexer" which appeared in the IEEE review of November 1976, pages 780 to 785.

The system of reflectors 7 and 8 in FIG. 2 remains unchanged from FIG. 1 because the example of the Cassegrain antenna considered above is retained.

There are two supply devices, namely a lower-band feed 40 and a higher-band feed 50. Feed 40 comprises a horn 1 identical to that of the single-band antenna, the dichroic mirror 30 playing the same part as the flat mirror 3 of FIG. 1. The dichroic mirror 30 is a "high pass" mirror whose cut-off frequency is such that it reflects the waves transmitted by the horn 1. These waves therefore follow a route identical to that of the waves in the single-band antenna.

The supply device or feed 50 of the higher band comprises a primary source 10 and a concave focusing mirror 9. The primary source 10, for example a corrugated horn, is parallel to the azimuth axis and like horn 1 radiates in an upward direction. The mirror 9 is situated so that the radiation beam of the higher band, which it reflects, is aimed at the dichroic mirror 30 and is superimposed on the reflected beam of the lower band beyond this mirror.

By suitably arranging the relative distances of the source 10, the focusing mirror 9 and the dichroic mirror 30, as well as the curvature of the mirror 9, there is obtained in the region of the dichroic mirror 30 a focusing of the field of the higher band similar to that undergone by the lower band.

In the assembly of FIG. 2, purity of polarization is obtained, as in the single-band antenna of FIG. 1, by a mutual compensation of the crossed polarizations created by each of the two focusing mirrors 4 and 5. It is sufficient to shape the central areas of these mirrors with great accuracy in order to obtain the same effect for the higher band as for the lower band.

It is seen in FIG. 2 that when the periscope 60 rotates around the azimuth axis AZ, it is necessary for the higher-band supply device 50 to carry out the same rotation; this device 50 is therefore mechanically linked to the periscope 60 which entrains the primary source 10.

One of the major drawbacks of this prior-art system is the mobility of source 10; since that source must in turn be supplied by a waveguide, not shown, the construction of the latter is difficult to realize.

OBJECT OF THE INVENTION

The object of our present invention is to provide an improved dual-band antenna designed to preserve the purity of polarization of radiant energy transmitted and received with mutually orthogonal polarization.

SUMMARY OF THE INVENTION

Such an antenna comprises, in accordance with our invention, a first feed for radiating an outgoing beam and receiving an incoming beam with a flat wavefront in a lower band of microwave frequencies, a second feed for radiating an outgoing beam and receiving an incoming beam with a flat wavefront in a higher band of microwave frequencies, a dichroic mirror centered on the azimuth axis and inclined thereto in a plane parallel to a bisector of the angle between the vertical azimuth axis and the horizontal elevational axis, this dichroic mirror reflecting frequencies in the lower band while passing frequencies in the upper band, and a periscopic supply system of the aforedescribed four-mirror type interposed between the dichroic mirror and a reflector assembly of Cassegrain type corresponding so that shown in FIGS. 1 and 2. The first feed includes a lower-frequency radiation source, a concave fifth mirror in line with that source, and a concave sixth mirror confronting the fifth mirror as well as an upper surface of the dichroic mirror; the second feed includes a higher-frequency radiation source in a beam path between the latter source and a lower surface of the dichroic mirror.

BRIEF DESCRIPTION OF THE DRAWING

The above and other features of our invention will become more readily apparent from the following description of an embodiment when read in conjunction with the accompanying drawing in which.

SPECIFIC DESCRIPTION

Figure 1:
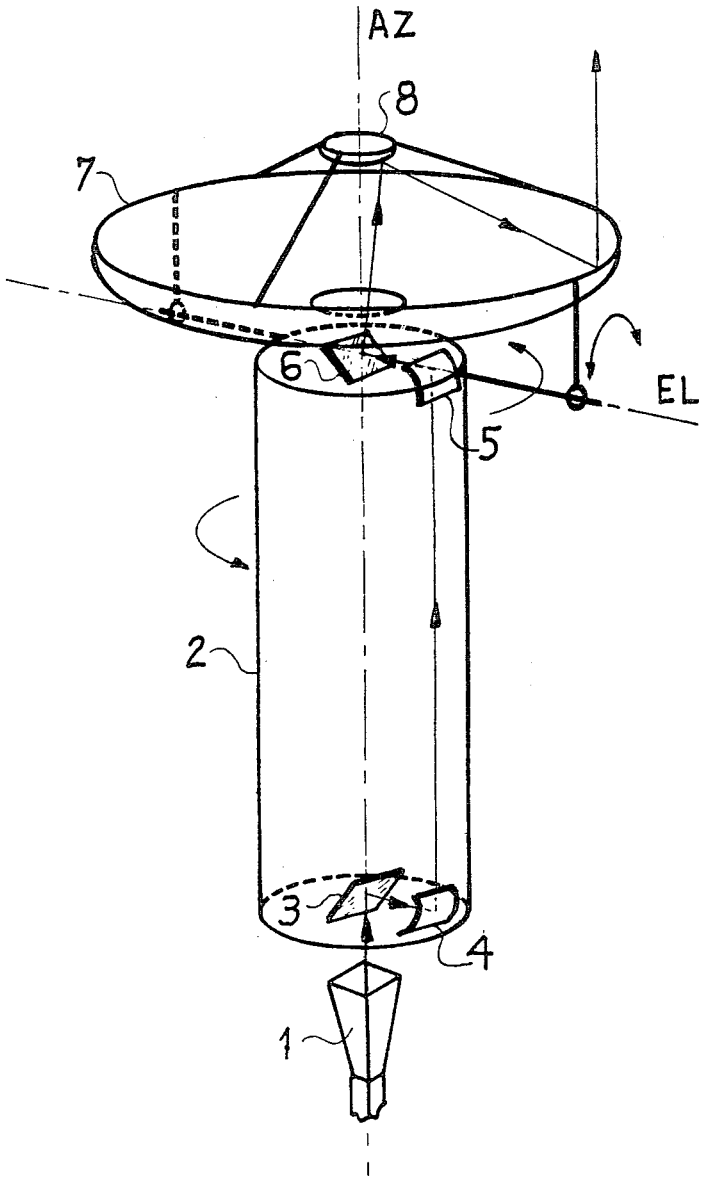
FIG 1 PRIOR ART
FIGS. 1 and 2, already discussed, are schematic representations of a single-band and a dual-band antenna, respectively, provided with a conventional periscopic supply system.
Figure 2:
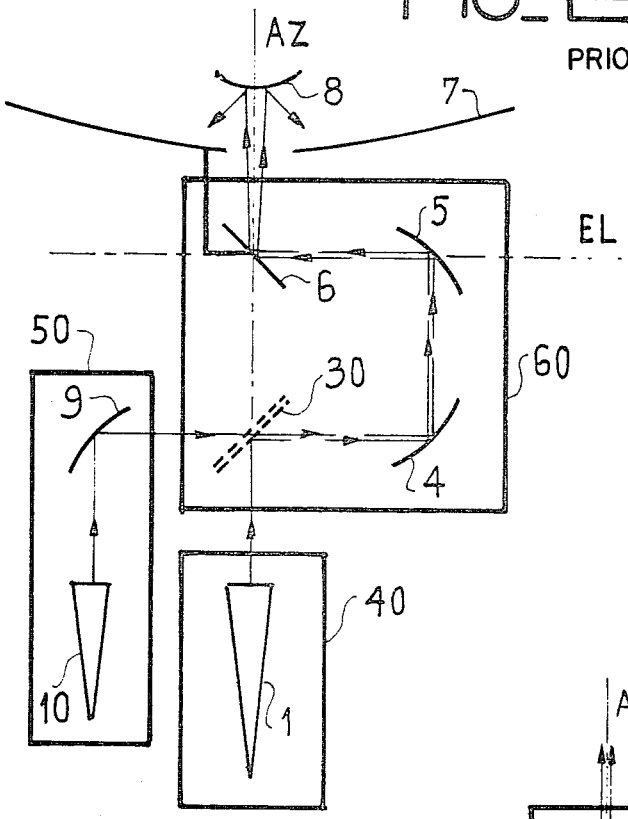
FIG 2 PRIOR ART
Figure 3:
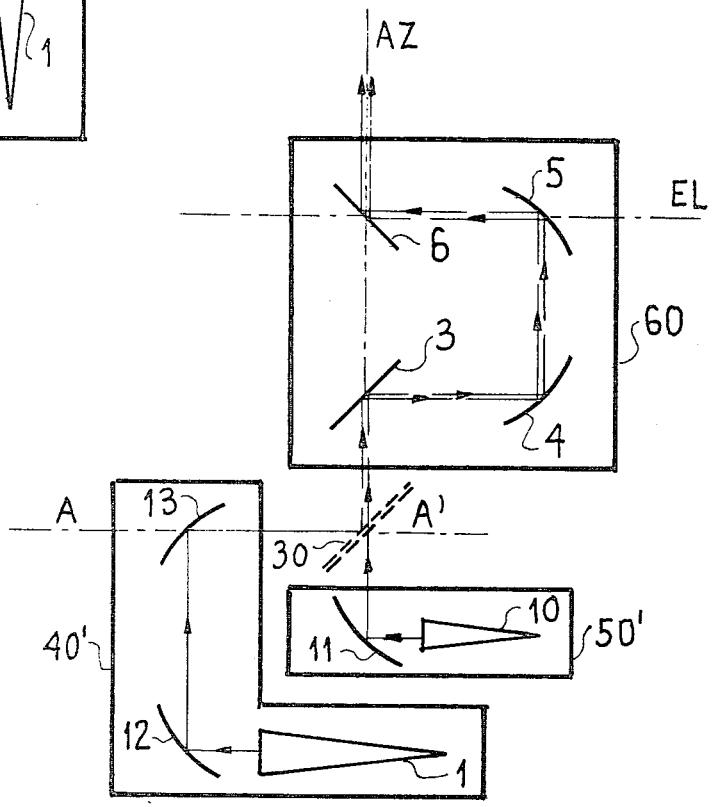
FIG. 3 is a diagram of a periscopic supply system for a dual-band antenna according to the invention.

FIG. 3 shows a periscope 60 with four mirrors 3, 4, 5 and 6, similar to that of the single-band antenna of FIG. 1. This periscope supplies a reflector system, e.g. of the Cassegrain type illustrated in FIGS. 1 and 2, which is not shown in FIG. 3.

A fixed separator device, here again shown as a dichroic mirror 30, is disposed below the periscope. This mirror is centered on the azimuth axis AS and parallel to the first mirror 3 of the periscope; it ensures on transmission the combination of the two outgoing beams respectively transmitted by two supply devices, i.e. a lower-band feed 40' and a higher-band feed 50', and the separation of two incoming beams on reception.

This type of mirror always functions better for reflection than for penetration so that it favors one band over the other. In the case of space telecommunications the band to be favored is the lower one. In the embodiment described, the dichroic mirror 30 is therefore of the "high-pass" type, that is to say it is transparent for the higher band and reflective for the lower band.

The higher-band excitation device or feed 50' transmits a wave train along the fixed axis AZ; this wave train passes through the mirror 30 and continues its route along the axis AZ towards mirror 3.

This excitation device or feed 50' comprises a primary source, here again a corrugated horn 10, supplied by a waveguide which is not shown in the drawing, and a certain number of mirrors here represented by a single focusing mirror 11 confronting the horn 10 and the lower surface of the inclined mirror 30. The horn 10 is placed parallel to the axis EL; the center of mirror 11 lies on the axis AZ and has a surface normal at this point parallel to a line bisecting the right angle between axes EL and AZ so that the direction of propagation of the beam reflected by this mirror is the axis AZ. The curvature of the mirror 11 and the relative distances of this mirror, the horn 10 and the dichroic mirror 30 are such that the field of radiation has a flat wave front at the level of this dichroic mirror.

The lower-band excitation device 40' transmits a wave train in a direction such that, after reflection on the mirror 30, the reflected beam is also propagated along the axis AZ, superimposing itself on the higher-band beam. For this purpose the wave train transmitted by the device 40' is thus distributed around an axis AA' parallel to the axis EL which passes through the center of the dichroic mirror 30.

This excitation device 40', in the embodiment of FIG. 3, comprises a primary source, in particular a corrugated horn 1, supplied by a waveguide not shown, and two focusing mirrors 12 and 13. The mirror 13 is centered on the axis AA' and confronts the upper surface of mirror 11. The mirror 12 is centered on a line parallel to the azimuth axis passing through the center of the mirror 13. The corrugated horn 1 has an axis of symmetry, corresponding to its mean direction of radiation, which is parallel to the elevational axis EL and passes through the center of the mirror 12.

The beam path between mirrors 12 and 13, shown to be vertical, can be made horizontal by rotating the feed 40' about axis AA'.

The geometric parameters (spacing and curvatures of focusing mirrors) of the two excitation devices as well as the distances of the dichroic mirror 30 from each feed 40', 50' and from the first mirror 3 of the periscope are determined according to principles well known in the art of periscopic supply systems for a frequency-reusing antenna. It is recalled that these parameters are chosen in such a way that on the one hand, in the area where the dichroic mirror 30 is located, there is observed for each of the two bands both a concentration of the field and a flat wavefront, and that on the other hand the structure of the field at the level of the dichroic mirror on transmission duplicates that issuing from the periscope on reception, which permits the field to be synthesized on reception as well as on transmission.

Such a periscopic supply system permits the transformation of a single-band antenna into a dual-band antenna without modification of the periscope structure itself and while keeping each of the excitation devices in a fixed position.

A preferred application of our invention is in the field of space telecommunications where the lower band covers the frequencies from 3.7 to 6.4 GHz, for example, and the higher band extends from 11 to 14.5 GHz. In this field the band used by the conventional single-band antennas corresponds to our lower band. Thus, it is to this band that the strictest standards of a dual-band antenna are applied; the excitation device 40' of FIG. 3, on account of the polarization compensation which it produces by the use of the two focusing mirrors 12 and 13, permits conservation of the purity of polarization of the periscope which is common for this frequency band. A similar excitation device with two focusing mirrors could also be used for the higher band where the standards therefor are as strict as those for the lower band.

We claim:

1. A dual-band antenna for the transmission and reception of radiant energy with mutually orthogonal polarization, comprising:

a reflector assembly of Cassegrain type rotatable about a vertical azimuth axis and pivotable about a horizontal elevational axis;

a first feed for radiating an outgoing beam and receiving an incoming beam with a flat wavefront in a lower band of microwave frequencies;

a second feed for radiating an outgoing beam and receiving an incoming beam with a flat wavefront in a higher band of microwave frequencies;

a dichroic mirror centered on said azimuth axis and inclined thereto in a plane parallel to a bisector of the angle between said azimuth and elevational axes, said dichroic mirror reflecting frequencies in said lower band while passing frequencies in said higher band; and a periscopic supply system interposed between said reflector assembly and said dichroic mirror, and supply system including oppositely inclined flat first and second mirrors disposed one above the other in line with said dichroic mirror and confronting concave third and fourth mirrors disposed one above the other at a location offset from said azimuth axis; said first feed including a lower-frequency radiation source, a concave fifth mirror in line with said lower-frequency source, and a concave sixth mirror confronting said fifth mirror and an upper surface of said dichroic mirror; said second feed including a higher-frequency radiation source and a seventh mirror in a beam path between said higher-frequency source and a lower surface of said dichroic mirror.

2. An antenna as defined in claim 1 wherein said sources are horns with horizontal axes of symmetry.

3. An antenna as defined in claim 1 or 2 wherein said sixth mirror lies on the level of said dichroic mirror and said seventh mirror is centered on said azimuth axis below said dichroic mirror.

* * * * *